US007446270B2

(12) United States Patent
Somalingayya et al.

(10) Patent No.: US 7,446,270 B2
(45) Date of Patent: Nov. 4, 2008

(54) INTERLOCK ASSEMBLIES FOR CIRCUIT BREAKERS

(75) Inventors: Veeresh Somalingayya, Bangalore (IN); Pankaj Shrivastava, Hyderabad (IN); Rajanikanta Pradhan, Orissa (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/646,673

(22) Filed: Dec. 28, 2006

(65) Prior Publication Data

US 2008/0149467 A1 Jun. 26, 2008

(30) Foreign Application Priority Data

Dec. 20, 2006 (IN) ..... 2727/DEL/2006

(51) Int. Cl.
*H01H 9/20* (2006.01)

(52) U.S. Cl. ..... 200/50.32; 200/50.33

(58) Field of Classification Search ..... 200/50.32–50.4
See application file for complete search history.

(56) References Cited

U.S. PATENT DOCUMENTS

| | | | | |
|---|---|---|---|---|
| 3,319,020 | A * | 5/1967 | Shaffer | 200/50.33 |
| 4,270,031 | A | 5/1981 | Borona et al. | 200/50 |
| D331,398 | S | 12/1992 | Clouss et al. | D14/114 |
| 5,393,942 | A * | 2/1995 | Reiner et al. | 200/50.4 |
| 6,031,193 | A | 2/2000 | Flegel | 200/50.33 |
| 6,043,439 | A | 3/2000 | Crooks et al. | 200/50.33 |
| 6,096,986 | A * | 8/2000 | Flegel | 200/50.33 |
| 6,184,595 | B1 | 2/2001 | Flegel, Jr. | 307/114 |
| 6,424,060 | B1 | 7/2002 | Shiely et al. | 307/328 |
| 6,621,689 | B1 * | 9/2003 | Flegel | 200/50.32 |
| 6,861,596 | B2 * | 3/2005 | Schnackenberg | 200/43.01 |
| 7,005,590 | B1 * | 2/2006 | Willis | 200/50.32 |
| 7,126,068 | B2 * | 10/2006 | Fillppenko | 200/50.33 |
| 2003/0155222 | A1 | 8/2003 | Schnackenberg | 200/50.32 |

* cited by examiner

*Primary Examiner*—Michael A Friedhofer
(74) *Attorney, Agent, or Firm*—Ohlandt, Greeley, Ruggiero & Perle, L.L.P.

(57) ABSTRACT

An interlock assembly comprising: an interlock plate comprising at least one slot disposed about a central portion thereof, a first locking tab disposed perpendicular to a first side of the interlock plate, and a second locking tab disposed perpendicular to a second side of the interlock plate; and a base disposed adjacent to a bottom surface of the interlock plate, the base comprising at least one perturbation disposed on a surface of the base opposite to the bottom surface of the interlock plate, such that the perturbation is disposed within the slot of the interlock plate, thereby providing the interlock plate with reciprocating movement in relation to the base.

18 Claims, 11 Drawing Sheets

INTERLOCK ASSEMBLIES FOR CIRCUIT BREAKERS

BACKGROUND

1. Field

This disclosure relates to interlock assemblies which can be used to prevent main and branch circuit breaker in a panelboard from being simultaneously in the "ON" position. In particular, the unique interlock assembly is particular with a generator panel or ATS (automatic transfer switch) switch when alternative power sources are used by customer to support critical loads in the event of failure of utility power supply.

2. Discussion of the Background Art

Mechanical interlocks which interconnect a pair of lever operated switches are well known. In circuit breaker panelboards, one such interlock has been mounted on the cover and has slidably interacted with the operator handles of tandemly (transversely) mounted circuit breakers. However, the interlock function is removed with the cover when servicing the panelboard in this version. Another panelboard has a sliding interlock mounted on a bracket which extends along the longitudinal center line of the panel. The ends of the bracket extend along the sides of the respective circuit breakers and are bolted directly to the panel or to the enclosure. One end of the bracket is offset from the center of the panel to clear a bus bar of the panelboard. A different length bracket is required for each panel accepting a different number of circuit breakers which translates into a different length for the panel. It is also necessary to modify the cover opening for the circuit breakers by notching the opening to receive the bracket at each end of the row of circuit breakers since the bracket extends beyond the side surface of the end circuit breakers. Thus, special covers are provided on panelboards or loadcenters utilizing this version of sliding interlock. The provision of special parts increases the cost of the item, both to manufacture and contractors to stock the different parts.

One such conventional interlock assembly is set forth in U.S. Pat. No. 5,393,942 to Reiner et al., which discloses a mechanical interlock for the operator handles of two main circuit breakers mounted in a panelboard or loadcenter. The interlock mounts transversely of the interior panel and therefore is not dependent upon the length of the interior panel. The interlock requires no special modification of any parts of the loadcenter or panelboard, thereby using all standard parts. The interlock attaches to the mounting rails of the interior panel by screw fasteners or the like and therefore can be used to provide a hold-down function for the main circuit breakers, thereby eliminating separate components for this function. The interlock slide may also be provided with padlock hasps whereby the operator handles of one or both of the circuit breakers can be locked in the OFF position by inserting the padlock shackle through the appropriate hasp of the interlock slide.

The problems associated with conventional interlock kits which convert panelboards to generator panels are that (1) they require ordering of separate front/shield to suit the interlock assemblies; (2) the interlock assemblies are costly due to intricate design involving large part counts, including auxiliary breaker retainers; and (3) convention interlock assemblies are difficult to install.

Additionally, the interlock assembly according to the present disclosure is not movably mounted on a bracket attached to mounting rails transversely of the panelboard. To the contrary, the present disclosure pertains to a novel interlock assembly that mounts directly to the panel deadfront.

The interlock assembly according to the present disclosure has the following advantages over conventional interlocks, i.e., (1) it is field installable to convert existing panelboards (loadcenter/meter socket loadcenter) into generator panels to support critical loads in residential applications utilizing alternate power sources, (2) its unique configuration allows for mounting directly over the deadfront/shield of a panelboard, (3) it interacts with breaker handles of main and auxiliary breaker to make sure only one breaker is in the "ON" position, and (4) it allows for both the main and auxiliary breakers to be put in the "OFF" position.

The present disclosure also provides many additional advantages, which shall become apparent as described below.

SUMMARY

The interlock assembly according to the present disclosure comprises a base plate and interlock plate forming an interlock assembly. The interlock plate with slots is joined to the base plate with a set of rivets. The base plate is mounted over the deadfront/shield of a panelboard. A template is typically provided along with the assembly kit to locate mounting holes taking appropriate references within the panelboard. The interlock plate interacts with breaker handles of main and auxiliary breakers to make sure only one breaker is in the "ON" position at a time. However, both the main and auxiliary breakers can be put into the "OFF" position or status.

Preferably, the interlock assembly according to the present disclosure is field installable to convert existing panelboards (i.e., loadcenter/meter socket loadcenter) into generator panelboards to support critical loads in residential applications utilizing an alternate power source.

Optionally, the interlock assembly may include a molded retainer auxiliary main breaker (i.e., plug-in type breaker) in its position to prevent its accidental removal. Such a retainer is mounted over interior the interior of the panelboard with the help of a faster.

An interlock assembly comprising: an interlock plate comprising at least one slot disposed about a central portion thereof, a first locking tab disposed perpendicular to a first side of the interlock plate, and a second locking tab disposed perpendicular to a second side of the interlock plate; and a base disposed adjacent to a bottom surface of the interlock plate, the base comprising at least one perturbation disposed on a surface of the base opposite to the bottom surface of the interlock plate, such that the perturbation is disposed within the slot of the interlock plate, thereby providing the interlock plate with reciprocating movement in relation to the base.

On embodiment involves the first locking tab comprises a first stop disposed perpendicular to the interlock plate and the second locking tab comprises a second stop disposed perpendicular to the interlock plate, wherein the first and second stops are facing in opposite directions to one another. In this embodiment the reciprocating movement of the interlock plate is in a direction of the axis between the first and second locking tabs.

In yet another embodiment the first locking tab comprises an elongated portion and a first end disposed parallel to and facing toward the interlock plate, and the second locking tab comprises an elongated portion and a second stop disposed parallel to and facing away from the interlock plate, wherein the first and second stops are facing in the same direction as one another. In this embodiment the reciprocating movement of the interlock plate is in a direction perpendicular to the axis between the first and second locking tabs.

In still another embodiment the first locking tab comprises an elongated portion and a first end disposed parallel to and facing toward the interlock plate, and the second locking tab comprises an elongated portion and a second stop disposed perpendicular to the interlock plate, wherein the first and second stops are facing in perpendicular directions to one another. The reciprocating movement of the interlock plate is in a direction of the axis between the first and second locking tabs.

Another embodiment involves the first locking tab comprises an elongated portion and a first stop disposed perpendicular to the interlock plate and the second locking tab comprises a second stop disposed perpendicular to the interlock plate, wherein the first and second stops are facing in opposite directions to one another. In this embodiment the reciprocating movement of the interlock plate is in a direction perpendicular to the axis between the first and second locking tabs.

The present disclosure also includes an interlock assembly comprising: an interlock plate comprising at least one slot disposed about a central portion thereof, a locking tab disposed perpendicular to a first side of the interlock plate; and a base disposed adjacent to a bottom surface of the interlock plate, the base comprising at least one perturbation disposed on a surface of the base opposite to the bottom surface of the interlock plate, such that the perturbation is disposed within the slot of the interlock plate, thereby providing the interlock plate with reciprocating movement in relation to the base. The locking tab comprises a stop disposed parallel to the interlock plate. The reciprocating movement of the interlock plate is parallel to the stop.

The present disclosure also includes an electrical panelboard adapted to be supplied from primary and alternative electrical supply sources, the panelboard comprising: a panel; a main circuit breaker comprising at least one main breaker handle; an auxiliary circuit breaker comprising at least one auxiliary breaker handle; and an interlock assembly comprising: an interlock plate comprising at least one slot disposed about a central portion thereof, a first locking tab disposed perpendicular to a first side of the interlock plate and in contact with the main breaker handle, and a second locking tab disposed perpendicular to a second side of the interlock plate and in contact with the auxiliary breaker handle; and a base disposed adjacent to a bottom surface of the interlock plate, the base comprising at least one perturbation disposed on a surface of the base opposite to the bottom surface of the interlock plate, such that the perturbation is disposed within the slot of the interlock plate, thereby providing the interlock plate with reciprocating movement in relation to the base, whereby the main breaker handle will be in the "OFF" position whenever the auxiliary breaker handle is in the "ON" position.

The present disclosure also includes an electrical panelboard adapted to be supplied from primary and alternative electrical supply sources, the panelboard comprising: a panel; a main circuit breaker comprising at least one main breaker handle; an auxiliary circuit breaker comprising at least one auxiliary breaker handle; and an interlock assembly comprising: an interlock plate comprising at least one slot disposed about a central portion thereof, a locking tab disposed perpendicular to a first side of the interlock plate; and a base disposed adjacent to a bottom surface of the interlock plate, the base comprising at least one perturbation disposed on a surface of the base opposite to the bottom surface of the interlock plate, such that the perturbation is disposed within the slot of the interlock plate, thereby providing the interlock plate with reciprocating movement in relation to the base, whereby the main breaker handle will be in the "OFF" position whenever the auxiliary breaker handle is in the "ON" position.

Further objects, features and advantages of the present disclosure will be understood by reference to the following drawings and detailed description.

DETAILED DESCRIPTION OF THE PREFERRED EMBODIMENT

Figure 1:
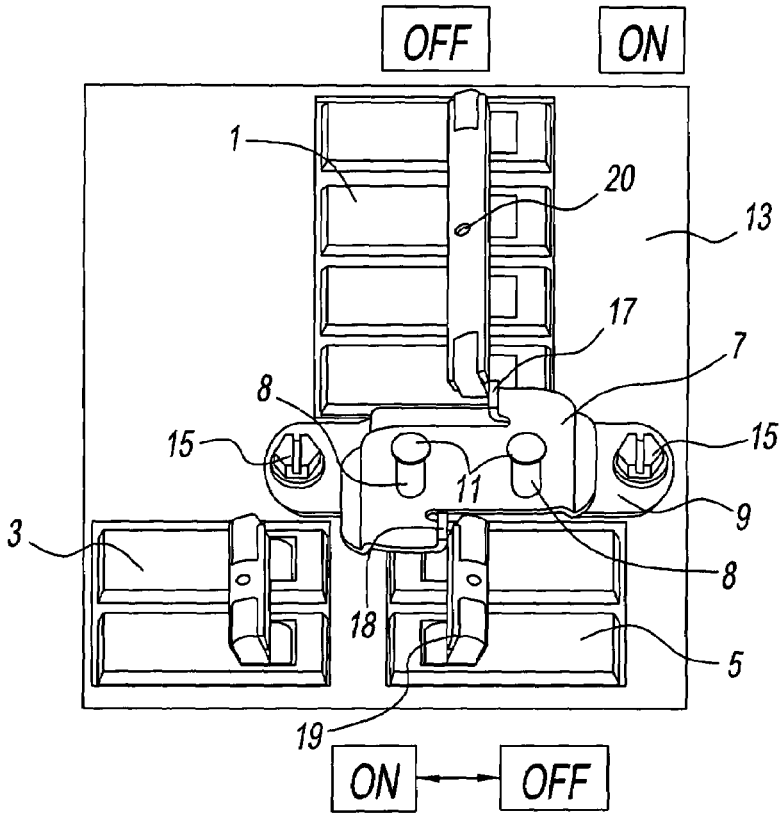
FIG. 1 is a schematic representation of an interlock assembly according to the present disclosure for use with an indoor/outdoor main circuit breaker panel, wherein both the main and auxiliary main breakers are in the "OFF" position.
Figure 2:
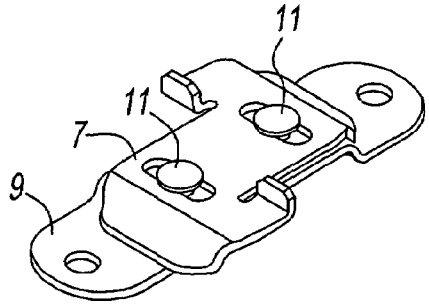
FIG. 2 is a schematic representation of the interlock assembly configuration of FIG. 1.

The present disclosure is best understood by reference to the attached figures, wherein FIGS. 1 and 2 provide a schematic representation of one embodiment according to the present disclosure suitable for indoor/outdoor main circuit breaker loadcenter. FIG. 1 depicts main breaker 1, branch breaker 3 and auxiliary breaker 5, wherein an interlock plate 7 with slots 8 are disposed over base plate 9 and secured thereto via rivets 11. Base plate 9 is secured to the front plate of deadfront/shield 13 of the panelboard via bolts 15. Interlock plate 7 includes oppositely disposed locking tabs 17, 18 disposed against breaker handles 19, 20, respectively.

According to FIG. 1 breaker handle 19 of auxiliary main breaker 5 is locked in the "OFF" position or status, whereas breaker handle 20 of main breaker 1 is also locked in the "OFF" position.

Figure 3B:
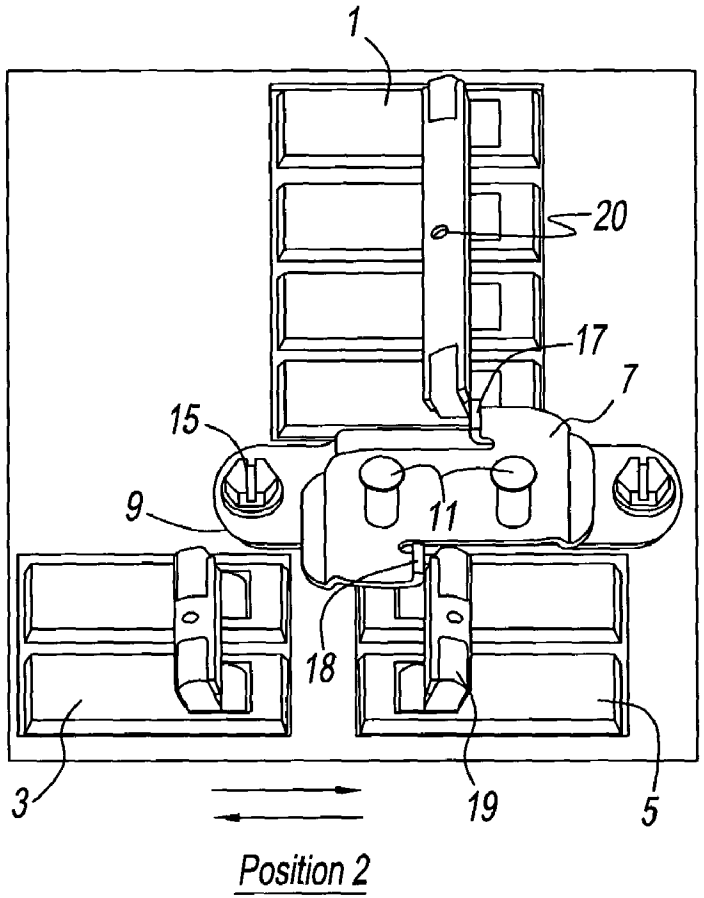
FIGS. 3*a-c* is schematic representation of the interlock assembly according to the embodiment of FIG. 1, wherein a functional sequence is showing the interlock assembly in three different operational positions.
Figure 3A:
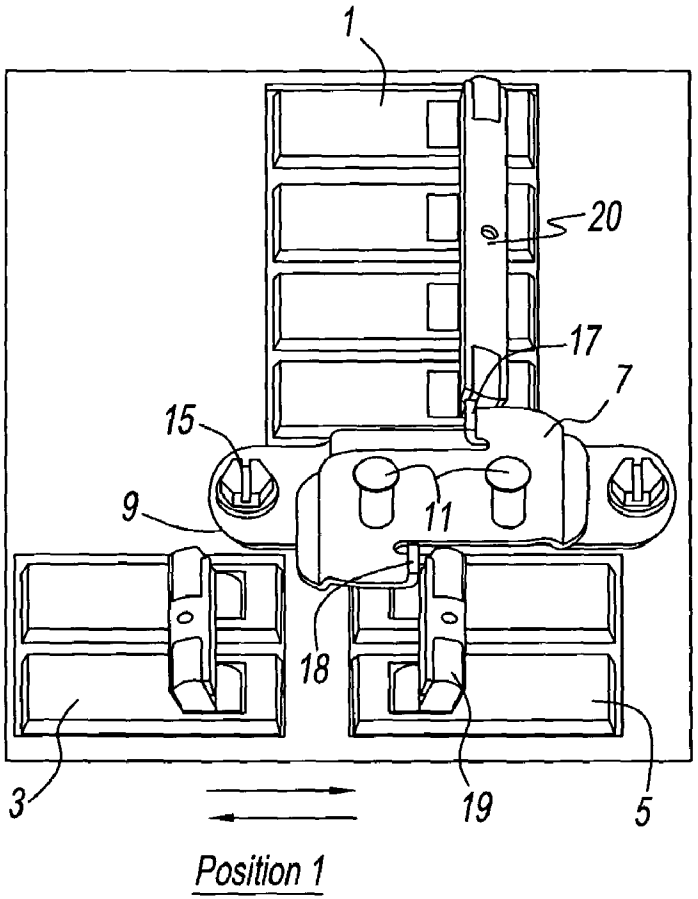
Figure 3C:
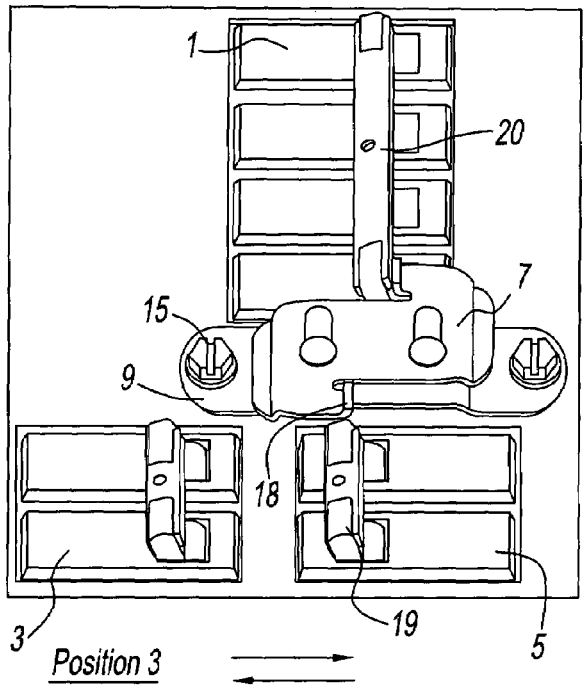

FIGS. 3*a-c* depicts three position of the interlocking assembly of FIG. 1, wherein FIG. 3*a* locks main breaker handle 20 in the "ON" position and auxiliary main breaker handle 19 in the "OFF" position. FIG. 3*b* locks breaker handle 20 in the "OFF" position and breaker handle 19 in the "OFF" position. FIG. 3*c* locks breaker handle 20 in the "OFF" position and breaker handle 19 in the "ON" position. To switch "ON" the auxiliary main breaker 5, switch "OFF" main breaker 1, slide interlock plate 7 upwards to lock the position of main breaker handle 20 and switch "ON" auxiliary main breaker 5. Both the breakers 1,5 will not be in the "ON" position at the same time as they are operated individually. Also, both the main and auxiliary breakers, 1,5 must be in the "OFF" position before any of the breakers switch to the "ON" position.

Figure 4:
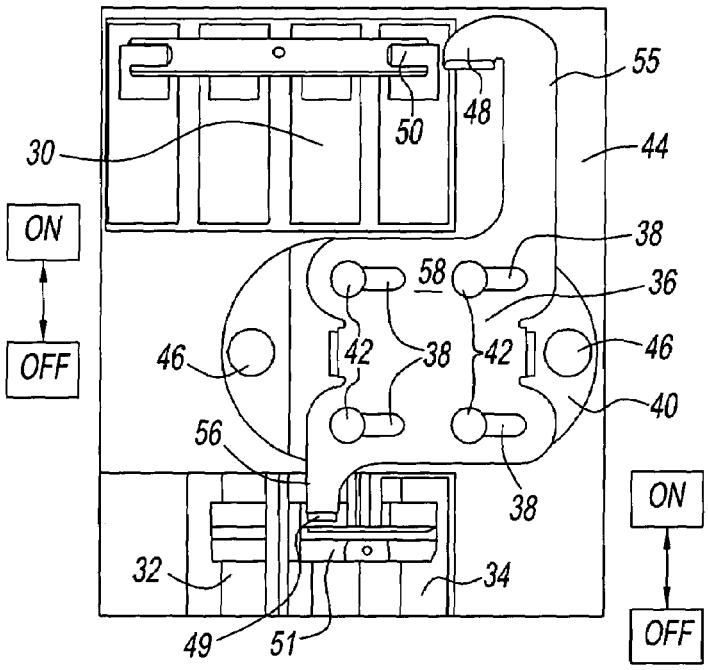
FIG. 4 is a schematic representation of an interlock assembly according to another embodiment of the present disclosure for use with a metersocket loadcenter.
Figure 5:
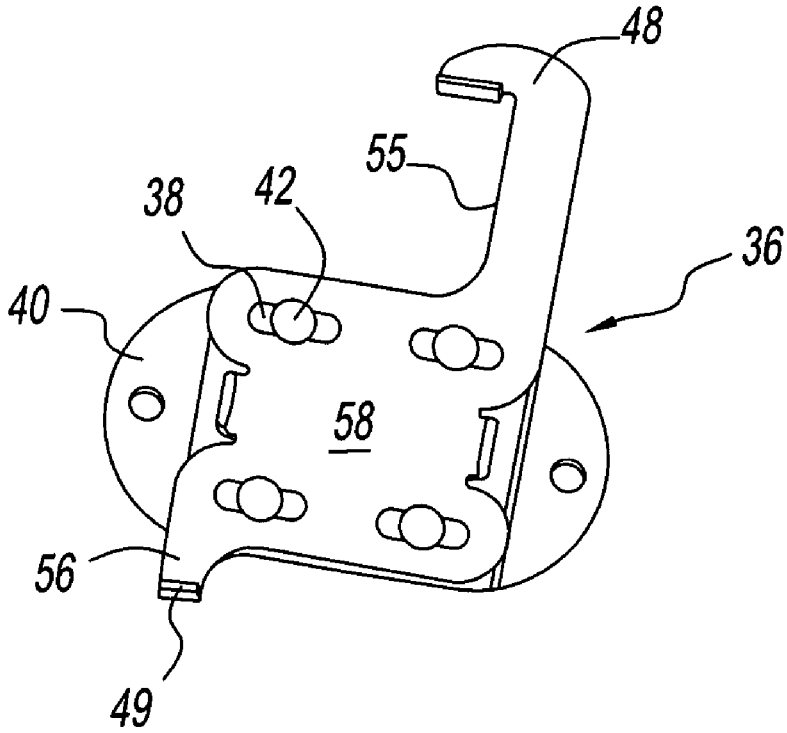
FIG. 5 is a schematic representation of the interlock assembly configuration of FIG. 4.

FIGS. 4 and 5 provide a schematic representation of another embodiment according to the present disclosure suitable for metersocket circuit breakers. FIG. 4 depicts main breaker 30, branch breaker 32 and auxiliary breaker 34, wherein an interlock plate 36 with slots 38 are disposed over base plate 40 and secured thereto via rivets 42. Base plate 40 is secured to the front plate of deadfront/shield 44 of the panelboard via bolts 46. Interlock plate 36 includes oppositely disposed locking tabs 48,49 disposed against breaker handles 50,51, respectively. Locking tab 48 comprises an elongated neck portion 55, whereas locking tab 49 has a short neck 56. In addition, interlock plate 36 include a large centrally disposed mid-section 58 which include at least four (4) slots 42. According to FIG. 4 breaker handle 51 of auxiliary main breaker 34 is locked in the "OFF" position or status, whereas breaker handle 50 of main breaker 30 is locked in the "ON" position.

Figure 6C:
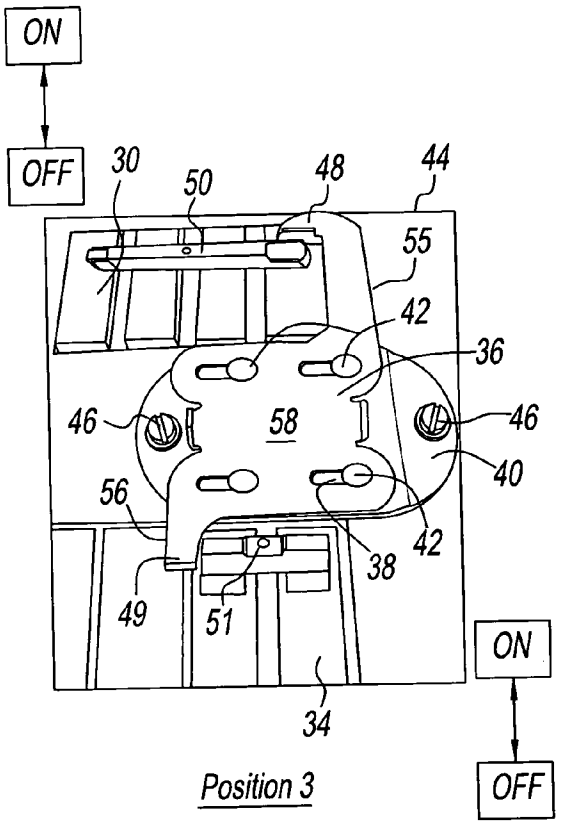
FIGS. 6*a-c* is schematic representation of the interlock assembly according to the embodiment of FIG. 4, wherein a function sequence is showing the interlock assembly in three different operational positions.
Figure 6B:
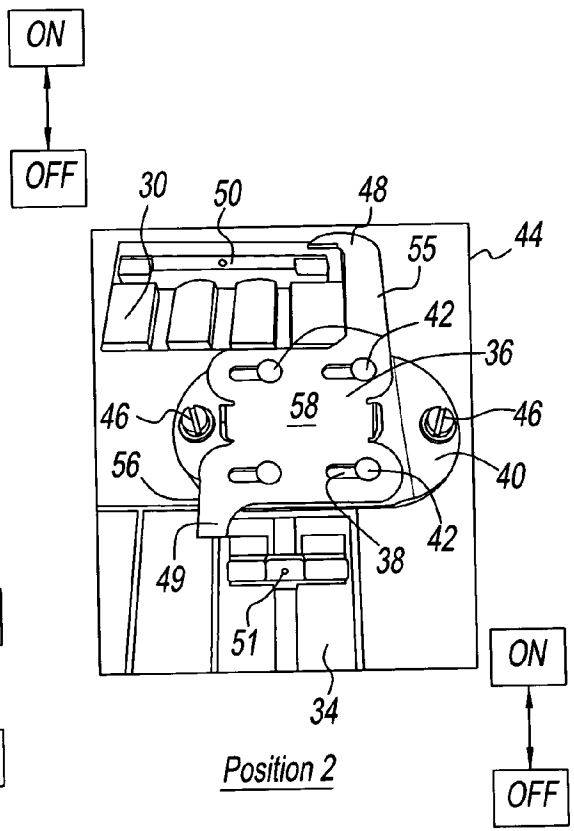
Figure 6A:
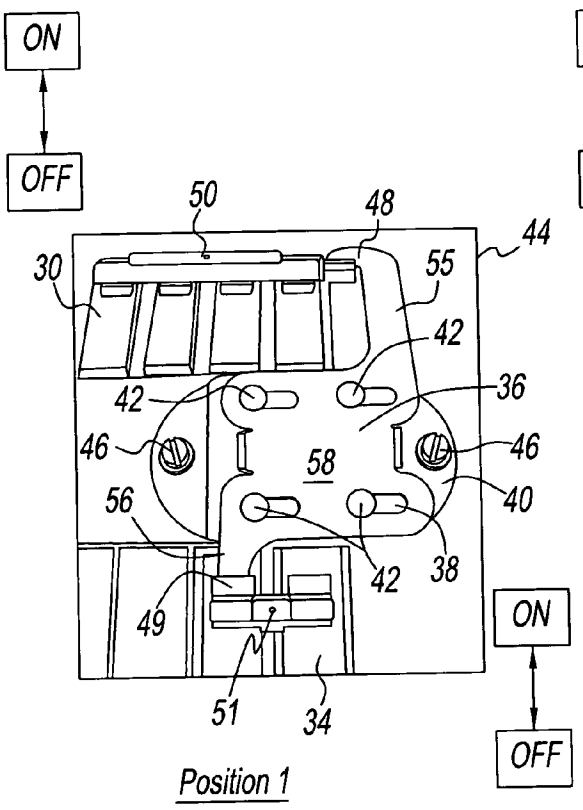

FIGS. 6*a-c* depicts three position of the interlocking assembly of FIG. 4, wherein FIG. 6*a* breaker handle 50 in the "ON" position and locks auxiliary main breaker handle 51 in the "OFF" position. FIG. 6*b* locks breaker handle 50 in the "OFF" position and breaker handle 51 is in the "OFF" position. FIG. 6*c* locks breaker handle 50 in the "OFF" position and breaker handle 51 in the "ON" position. To switch "ON" the auxiliary main breaker 34, switch "OFF" main breaker 30, slide interlock plate 36 leftwards to lock the position of main breaker handle 50 and switch "ON" auxiliary main breaker 34. Both the breakers 30,34 will not be in the "ON" position at the same time as they are operated individually. Also, both the main and auxiliary breakers, 30,34 must be in the "OFF" position before any of the breakers switch to the "ON" position.

Figure 7:
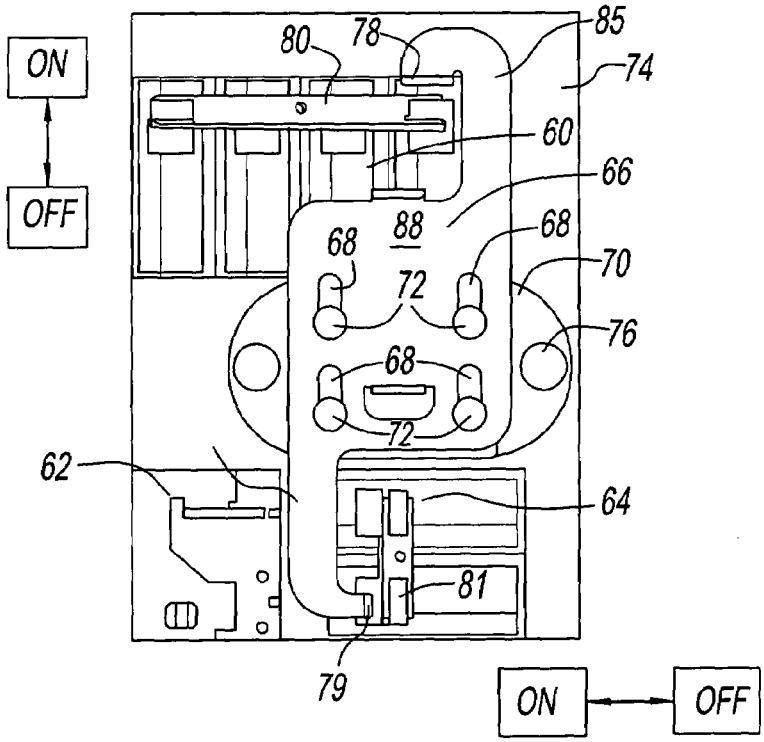
FIG. 7 is a schematic representation of an interlock assembly according to another embodiment of the present disclosure for use with a metersocket loadcenter.
Figure 8:
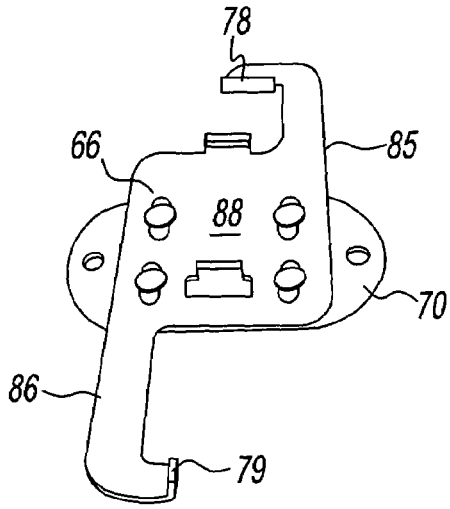
FIG. 8 is a schematic representation of the interlock assembly configuration of FIG. 7.

FIGS. 7 and 8 provide a schematic representation of another embodiment according to the present disclosure suitable for metersocket circuit breakers. FIG. 7 depicts main breaker 60, branch breaker 62 and auxiliary breaker 64, wherein an interlock plate 66 with slots 68 are disposed over base plate 70 and secured thereto via rivets 72. Base plate 70 is secured to the front plate of deadfront/shield 74 of the panelboard via bolts 76. Interlock plate 66 includes oppositely disposed locking tabs 78,79 disposed against breaker handles 80,81, respectively. Locking tab 78 comprises an elongated neck portion 85 and generally C-shaped, and locking tab 79 has a elongated neck portion 86 and is generally L-shaped. In addition, interlock plate 66 include a large centrally disposed mid-section 88 which include at least four (4) slots 72. According to FIG. 7 breaker handle 81 of auxiliary main breaker 64 is locked in the "OFF" position or status, whereas breaker handle 80 of main breaker 60 is locked in the "ON" position.

Figures 9A, 9B, 9C:
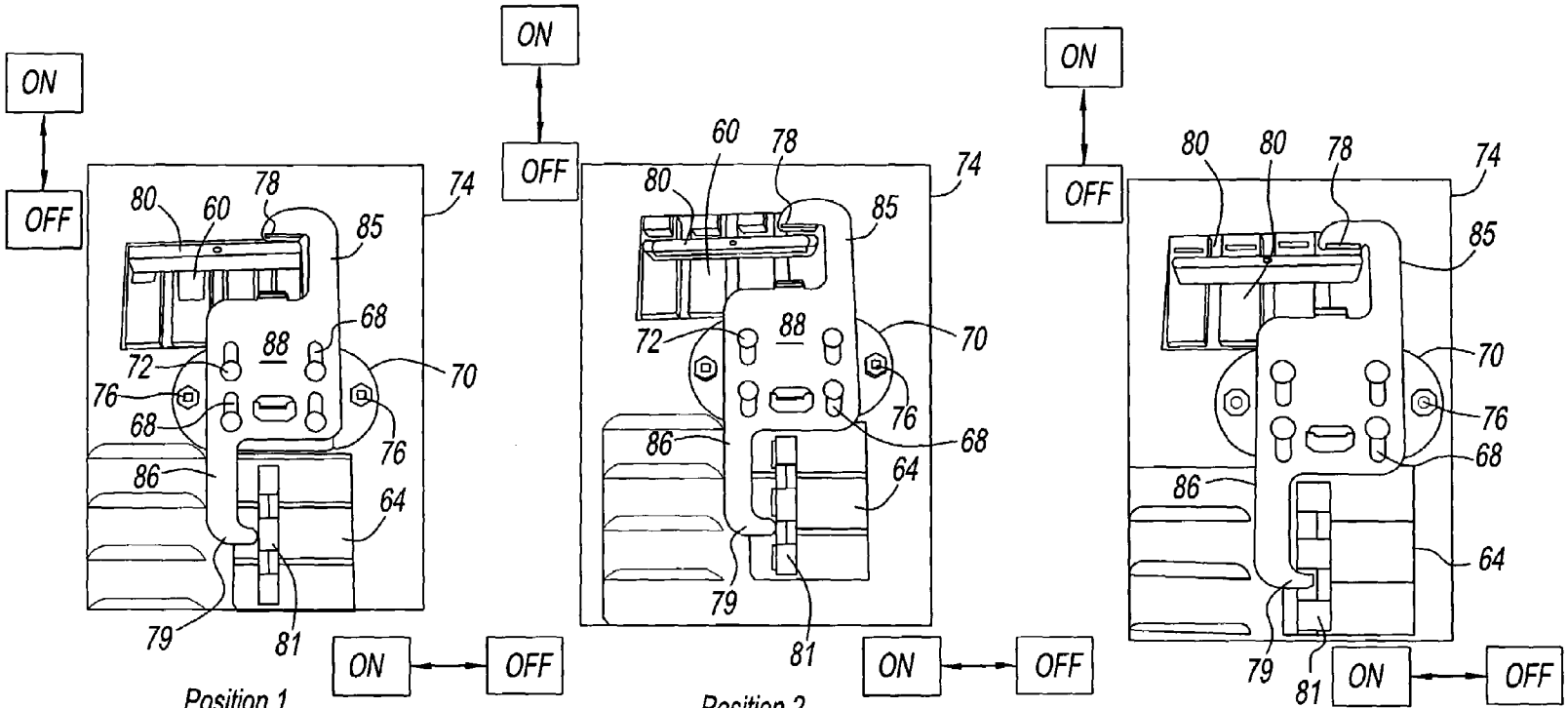
FIGS. 9*a-c* is schematic representation of the interlock assembly according to the embodiment of FIG. 7, wherein a functional sequence is showing the interlock assembly in three different operational positions.

FIGS. 9*a-c* depicts three position of the interlocking assembly of FIG. 7, wherein FIG. 9*a* locks breaker handle 80 in the "ON" position and breaker handle 81 in the "OFF" position. FIG. 9*b* locks breaker handle 80 in the "OFF" position and breaker handle 81 in the "OFF" position. FIG. 9*c* locks breaker handle 80 in the "OFF" position and breaker handle 81 in the "ON" position. To switch "ON" the auxiliary main breaker 64, switch "OFF" main breaker 60, slide interlock plate 66 downward to lock the position of main breaker handle 80 and switch "ON" auxiliary main breaker 64. Both the breakers 60,64 will not be in the "ON" position at the same time as they are operated individually. Also, both the main and auxiliary breakers, 60,64 must be in the "OFF" position before any of the breakers switch to the "ON" position.

Figure 10:
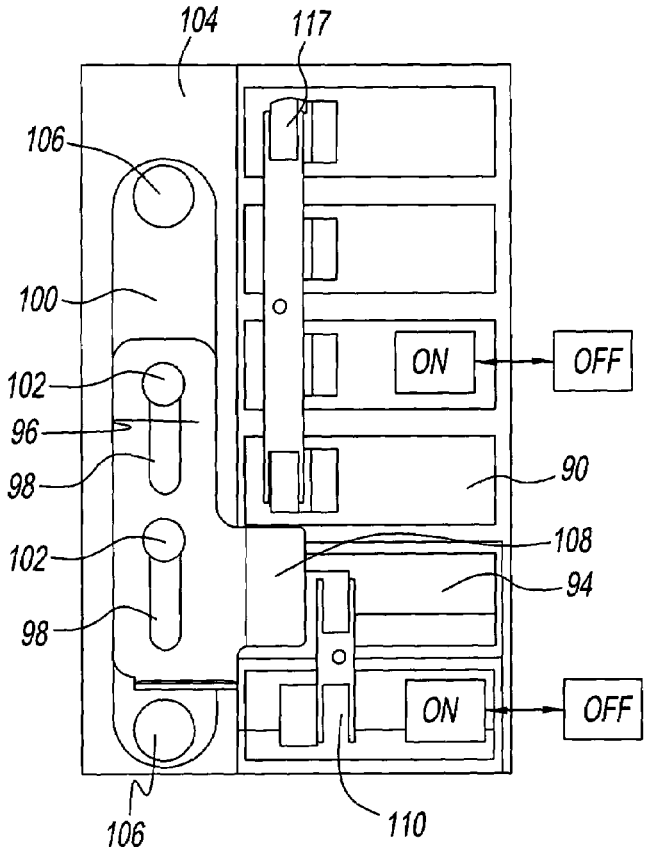
FIG. 10 is a schematic representation of an interlock assembly according to another embodiment of the present disclosure for use with a metersocket loadcenter.
Figure 11:
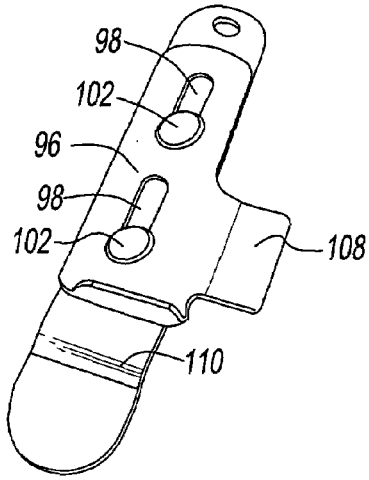
FIG. 11 is a schematic representation of the interlock assembly configuration of FIG. 10.

FIGS. 10 and 11 provide a schematic representation of another embodiment according to the present disclosure suitable for metersocket circuit breakers. FIG. 10 depicts main breaker 90 and auxiliary breaker 94, wherein an interlock plate 96 with slots 98 are disposed over base plate 100 and secured thereto via rivets 102. Base plate 100 is secured to the front plate of deadfront/shield 104 of the panelboard via bolts 106. Interlock plate 96 includes locking tab 108 disposed against breaker handle 110, respectively. Locking tab 108 comprises are retangularly shaped portion that is disposed perpendicular from interlock plate 96. According to FIG. 10 breaker handle 110 of auxiliary main breaker 94 is locked in the "OFF" position or status, whereas breaker handle 117 of main breaker 90 is locked in the "ON" position.

Figure 12C:
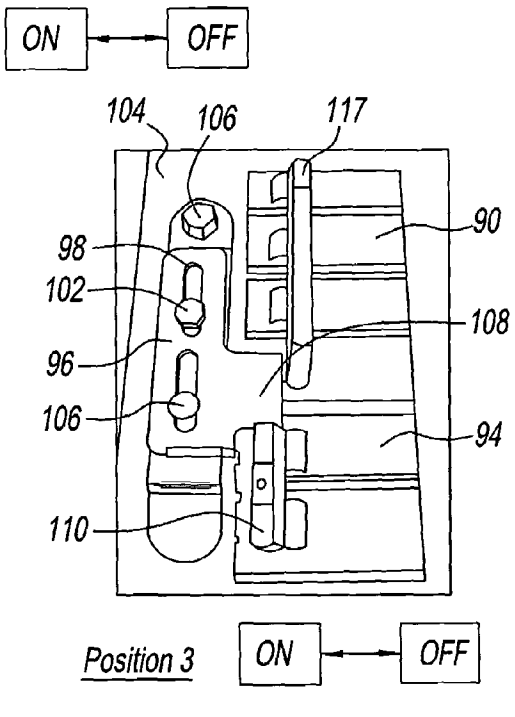
FIGS. 12*a-c* is schematic representation of the interlock assembly according to the embodiment of FIG. 10, wherein a functional sequence is showing the interlock assembly in three different operational positions.
Figure 12B:
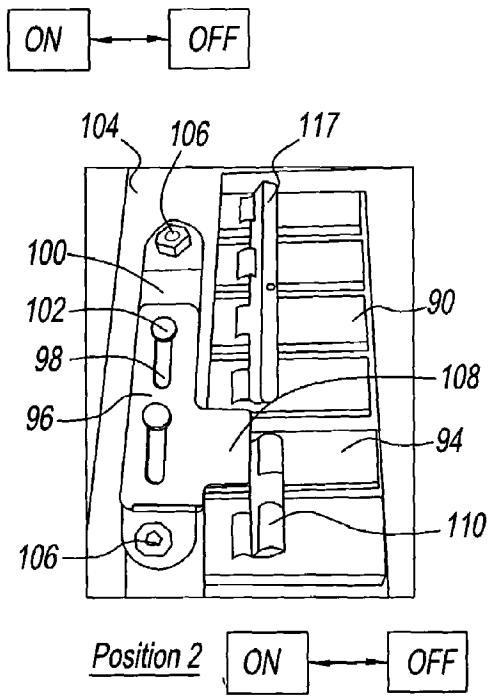
Figure 12A:
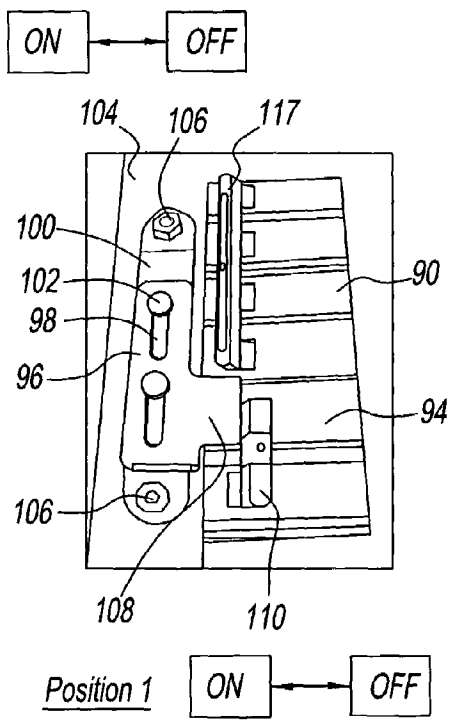

FIGS. 12*a-c* depicts three position of the interlocking assembly of FIG. 10, wherein FIG. 12*a* locks breaker handle 117 in the "ON" position and breaker handle 110 in the "OFF" position. FIG. 12*b* locks breaker handle 117 in the "OFF" position and breaker handle 110 in the "OFF" position. FIG. 12*c* locks breaker handle 117 in the "OFF" position and breaker handle 110 in the "ON" position. To switch "ON" the auxiliary main breaker 94, switch "OFF" main breaker 90, slide interlock plate 96 upwards to lock the position of main breaker handle 117 and switch "ON" auxiliary main breaker 94. Both the breakers 90,94 will not be in the "ON" position at the same time as they are operated individually. Also, both the main and auxiliary breakers, 90,94 must be in the "OFF" position before any of the breakers switch to the "ON" position.

Figure 13:
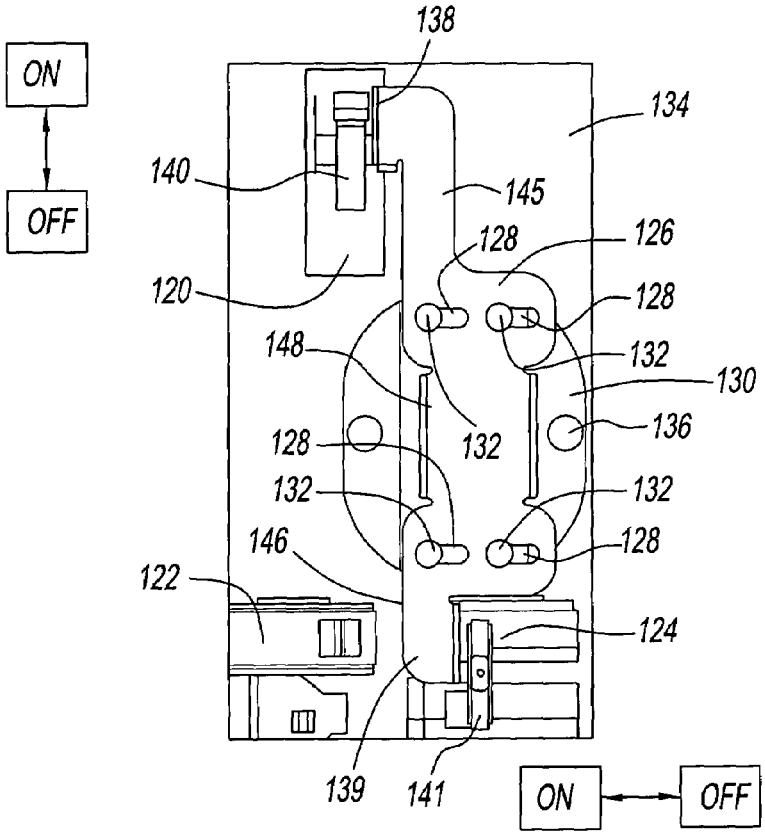
FIG. 13 is a schematic representation of an interlock assembly according to another embodiment of the present disclosure for use with a metersocket loadcenter.
Figure 14:
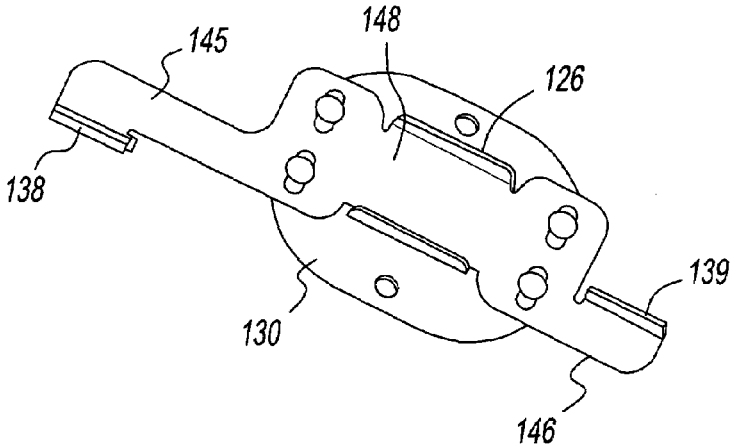
FIG. 14 is a schematic representation of the interlock assembly configuration of FIG. 13.

FIGS. 13 and 14 provide a schematic representation of another embodiment according to the present disclosure suitable for metersocket circuit breakers. FIG. 13 depicts main breaker 120, branch breaker 122 and auxiliary breaker 124, wherein an interlock plate 126 with slots 128 are disposed over base plate 130 and secured thereto via rivets 132. Base plate 130 is secured to the front plate of deadfront/shield 134 of the panelboard via bolts 136. Interlock plate 126 includes oppositely disposed locking tabs 138,139 disposed against breaker handles 140,141, respectively. Locking tab 138 comprises an elongated neck portion 145 and generally L-shaped, and locking tab 139 has a shortened neck portion 146 and is generally I-shaped. In addition, interlock plate 126 include an elongated centrally disposed mid-section 148 which include at least four (4) slots 128. According to FIG. 13 breaker handle 141 of auxiliary main breaker 124 is locked in the "OFF" position or status, whereas breaker handle 140 of main breaker 120 is locked in the "ON" position.

Figure 15C:
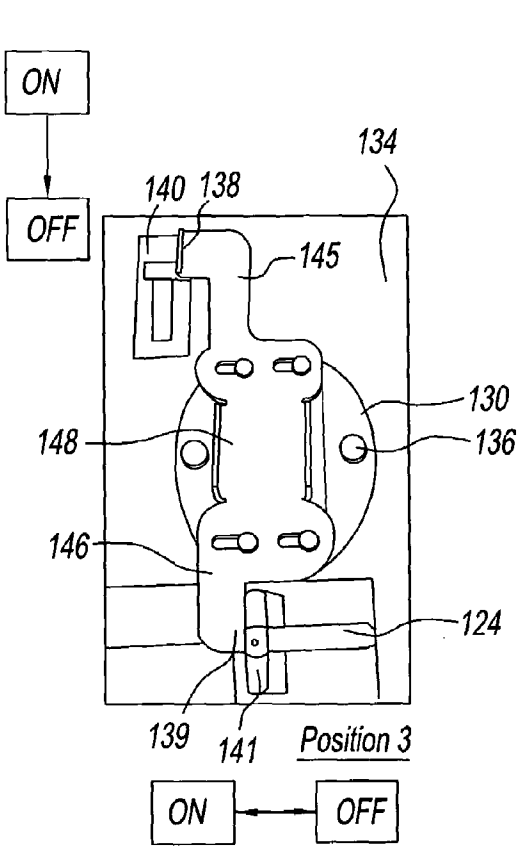
FIGS. 15*a-c* is schematic representation of the interlock assembly according to the embodiment of FIG. 13, wherein a functional sequence is showing the interlock assembly in three different operational positions.
Figure 15B:
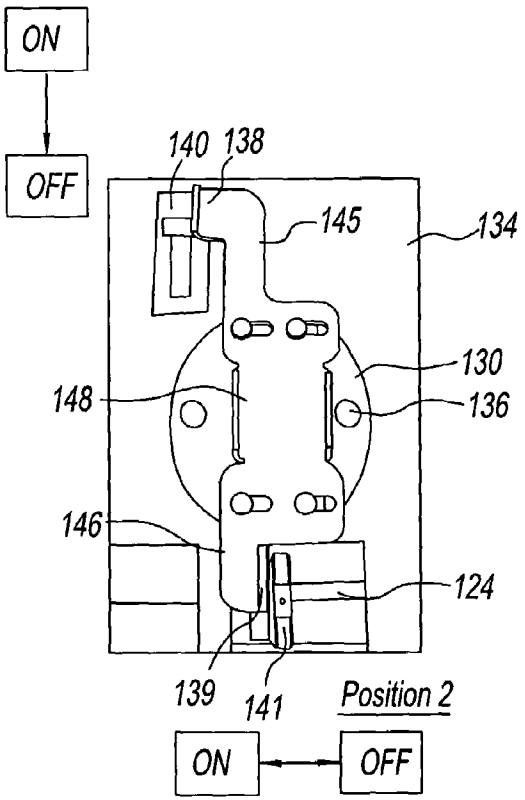
Figure 15A:
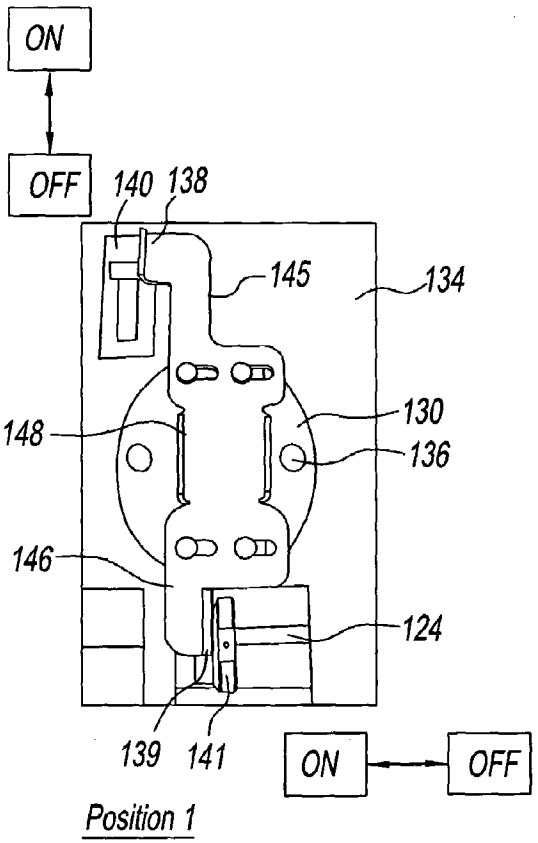

FIGS. 15*a-c* depicts three position of the interlocking assembly of FIG. 13, wherein FIG. 15*a* locks breaker handle 140 in the "ON" position and breaker handle 141 in the "OFF" position. FIG. 15*b* locks breaker handle 140 in the "OFF" position and breaker handle 141 in the "OFF" position. FIG. 15*c* locks breaker handle 140 in the "OFF" position and breaker handle 141 in the "ON" position. To switch "ON" the auxiliary main breaker 124, switch "OFF" main breaker 120, slide interlock plate 126 leftward to lock the position of main breaker handle 140 and switch "ON" auxiliary main breaker 124. Both the breakers 120,124 will not be in the "ON" position at the same time as they are operated individually. Also, both the main and auxiliary breakers, 120,124 must be in the "OFF" position before any of the breakers switch to the "ON" position.

While we have shown and described several embodiments in accordance with our invention, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. An interlock assembly comprising:

an interlock plate comprising at least one slot disposed about a central portion thereof, a first locking tab disposed perpendicular to a first side of said interlock plate, and a second locking tab disposed perpendicular to a second side of said interlock plate; and a base disposed adjacent to a bottom surface of said interlock plate, said base comprising at least one perturbation disposed on a surface of said base opposite to said bottom surface of said interlock plate, such that said at least one perturbation is disposed within said at least one slot of said interlock plate, thereby providing said interlock plate with reciprocating movement in relation to said base, wherein said first locking tab comprises an elongated portion and a first end disposed parallel to and facing toward said interlock plate, and said second locking tab comprises an elongated portion and a second stop disposed parallel to and facing away from said interlock plate, wherein said first and second stops are facing in a same direction as one another.

2. The interlock assembly according to claim 1, wherein said first locking tab comprises a first stop disposed perpendicular to said interlock plate and said second locking tab comprises a second stop disposed perpendicular to said interlock plate, wherein said first and second stops are facing in opposite directions to one another.

3. The interlock assembly according to claim 2, wherein said reciprocating movement of said interlock plate is in a direction of the axis between said first and second locking tabs.

4. The interlock assembly according to claim 1, wherein said reciprocating movement of said interlock plate is in a direction perpendicular to an axis between said first and second locking tabs.

5. The interlock assembly according to claim 1, wherein said first locking tab comprises an elongated portion and a first stop disposed perpendicular to said interlock plate and said second locking tab comprises a second stop disposed perpendicular to said interlock plate, wherein said first and second stops are facing in opposite directions to one another.

6. The interlock assembly according to claim 5, wherein said reciprocating movement of said interlock plate is in a direction perpendicular to an axis between said first and second locking tabs.

7. An interlock assembly comprising:

an interlock plate comprising at least one slot disposed about a central portion thereof, a first locking tab disposed perpendicular to a first side of said interlock plate, and a second locking tab disposed perpendicular to a second side of said interlock plate; and a base disposed adjacent to a bottom surface of said interlock plate, said base comprising at least one perturbation disposed on a surface of said base opposite to said bottom surface of said interlock plate, such that said at least one perturbation is disposed within said at least one slot of said interlock plate, thereby providing said interlock plate with reciprocating movement in relation to said base, wherein said first locking tab comprises an elongated portion and a first end disposed parallel to and facing toward said interlock plate, and said second locking tab comprises an elongated portion and a second stop disposed perpendicular to said interlock plate, wherein said first and second stops are facing in perpendicular directions to one another.

8. The interlock assembly according to claim 7, wherein said reciprocating movement of said interlock plate is in a direction of an axis between said first and second locking tabs.

9. An electrical panelboard for being supplied from primary and alternative electrical supply sources, said panelboard comprising:

a panel;

a main circuit breaker comprising at least one main breaker handle;

an auxiliary circuit breaker comprising at least one auxiliary breaker handle; and an interlock assembly comprising: an interlock plate comprising at least one slot disposed about a central portion thereof, a first locking tab disposed perpendicular to a first side of said interlock plate and in contact with said main breaker handle, and a second locking tab disposed perpendicular to a second side of said interlock plate and in contact with said auxiliary breaker handle; and a base disposed adjacent to a bottom surface of said interlock plate, said base comprising at least one perturbation disposed on a surface of said base opposite to said bottom surface of said interlock plate, such that said at least one perturbation is disposed within said at least one slot of said interlock plate, thereby providing said interlock plate with reciprocating movement in relation to said base, whereby said main breaker handle will be in the "OFF" position whenever said auxiliary breaker handle is in the "ON" position, wherein said first locking tab comprises an elongated portion and a first end disposed parallel to and facing toward said interlock plate, and said second locking tab comprises an elongated portion and a second stop disposed parallel to and facing away from said interlock plate, wherein said first and second stops are facing in a same direction as one another.

10. The electrical panelboard according to claim 9, wherein said first locking tab comprises a first stop disposed perpendicular to said interlock plate and said second locking tab comprises a second stop disposed perpendicular to said interlock plate, wherein said first and second stops are facing in opposite directions to one another.

11. The electrical panelboard according to claim 10, wherein said reciprocating movement of said interlock plate is in a direction of an axis between said first and second locking tabs.

12. The electrical panelboard according to claim 9, wherein said reciprocating movement of said interlock plate is in a direction perpendicular to the axis between said first and second locking tabs.

13. The electrical panelboard according to claim 9, wherein said first locking tab comprises an elongated portion and a first stop disposed perpendicular to said interlock plate and said second locking tab comprises a second stop disposed perpendicular to said interlock plate, wherein said first and second stops are facing in opposite directions to one another.

14. The electrical panelboard according to claim 13, wherein said reciprocating movement of said interlock plate is in a direction perpendicular to an axis between said first and second locking tabs.

15. An electrical panelboard for being supplied from primary and alternative electrical supply sources, said panelboard comprising:

a panel;

a main circuit breaker comprising at least one main breaker handle;

an auxiliary circuit breaker comprising at least one auxiliary breaker handle; and an interlock assembly comprising: an interlock plate comprising at least one slot disposed about a central portion thereof, a first locking tab disposed perpendicular to a first side of said interlock plate and in contact with said main breaker handle, and a second locking tab disposed perpendicular to a second side of said interlock plate and in contact with said auxiliary breaker handle; and a base disposed adjacent to a bottom surface of said interlock plate, said base comprising at least one perturbation disposed on a surface of said base opposite to said bottom surface of said interlock plate, such that said at least one perturbation is disposed within said at least one slot of said interlock plate, thereby providing said interlock plate with reciprocating movement in relation to said base, whereby said main breaker handle will be in the "OFF" position whenever said auxiliary breaker handle is in the "ON" position, wherein said first locking tab comprises an elongated portion and a first end disposed parallel to and facing toward said interlock plate, and said second locking tab comprises an elongated portion and a second stop disposed perpendicular to said interlock plate, wherein said first and second stops are facing in perpendicular directions to one another.

16. The electrical panel board according to claim 15, wherein said reciprocating movement of said interlock plate is in a direction of an axis between said first and second locking tabs.

17. An electrical panelboard for being supplied from primary and alternative electrical supply sources, said panelboard comprising:

a panel;

a main circuit breaker comprising at least one main breaker handle;

an auxiliary circuit breaker comprising at least one auxiliary breaker handle; and an interlock assembly comprising: an interlock plate comprising at least one slot disposed about a central portion thereof, a locking tab disposed perpendicular to a first side of said interlock plate; and a base disposed adjacent to a bottom surface of said interlock plate, said base comprising at least one perturbation disposed on a surface of said base opposite to said bottom surface of said interlock plate, such that said at least one perturbation is disposed within said at least one slot of said interlock plate, thereby providing said interlock plate with reciprocating movement in relation to said base, whereby said main breaker handle will be in the "OFF" position whenever said auxiliary breaker handle is in the "ON" position, wherein said reciprocating movement of said interlock plate is parallel to said locking tab.

18. The electrical panelboard according to claim 17, wherein said locking tab comprises a stop disposed parallel to said interlock plate.

* * * * *